US005906081A

United States Patent [19]

Mäntylä

[11] Patent Number: 5,906,081

[45] Date of Patent: May 25, 1999

[54] WALL CONSTRUCTION AND METHOD OF MANUFACTURING A WALL CONSTRUCTION

[75] Inventor: Juhani Mäntylä , Harjavalta, Finland

[73] Assignee: Ma-Rakennus J. Mäntylä KY, Harjavalta, Finland

[21] Appl. No.: 08/945,693

[22] PCT Filed: Apr. 29, 1996

[86] PCT No.: PCT/FI96/00229

§ 371 Date: Dec. 2, 1997

§ 102(e) Date: Dec. 2, 1997

[87] PCT Pub. No.: WO96/35024

PCT Pub. Date: Nov. 7, 1996

[30] Foreign Application Priority Data

May 4, 1995 [FI] Finland ..... 952149

[51] Int. Cl.[6] ..... E04B 9/00

[52] U.S. Cl. ..... 52/344; 52/367; 52/352

[58] Field of Search ..... 52/344, 352, 353, 52/355, 367

[56] References Cited

U.S. PATENT DOCUMENTS

| | | | |
|---|---|---|---|
| 466,147 | 12/1891 | Beaumont | 52/344 X |
| 1,569,144 | 1/1926 | Scammell | 52/344 X |
| 1,592,807 | 7/1926 | Forrest | 52/344 |
| 4,193,240 | 3/1980 | Odoerfer | 52/344 |
| 4,472,919 | 9/1984 | Nourse | 52/344 X |

FOREIGN PATENT DOCUMENTS

| | | |
|---|---|---|
| 82718 | 4/1957 | Denmark . |
| 107 460 A2 | 5/1984 | European Pat. Off. . |
| 245 180 A1 | 11/1987 | European Pat. Off. . |
| 0 683 282 A1 | 11/1995 | European Pat. Off. . |
| 75389 | 2/1988 | Finland . |
| 2 525 657 | 10/1983 | France . |
| 2653223 | 6/1977 | Germany . |
| 39 21 881 A1 | 1/1991 | Germany . |
| 42 17 957 A1 | 2/1993 | Germany . |
| 42 15 081 A1 | 11/1993 | Germany . |
| 1599033 | 9/1981 | United Kingdom . |
| WO 93/21403 | 10/1993 | WIPO . |
| WO 95/12714 | 5/1995 | WIPO . |

*Primary Examiner*—Creighton Smith
*Attorney, Agent, or Firm*—Burns, Doane, Swecker & Mathis LLP

[57] ABSTRACT

A wall construction comprising supporting poles, a close-meshed metal net attached thereto and a wall portion consisting of filling material and cast into spaces formed by the supporting poles and the metal net. In the method, supporting poles are mounted in place and a close-meshed metal net is attached thereto. On the outside of the metal net are fastened support boards at spaced intervals. Into spaces formed by the supporting poles and the metal net is cast filling material. The metal net acting as a mould forms part of the wall construction and together with the filling material a reinforcement.

17 Claims, 1 Drawing Sheet

WALL CONSTRUCTION AND METHOD OF MANUFACTURING A WALL CONSTRUCTION

Figure 1:
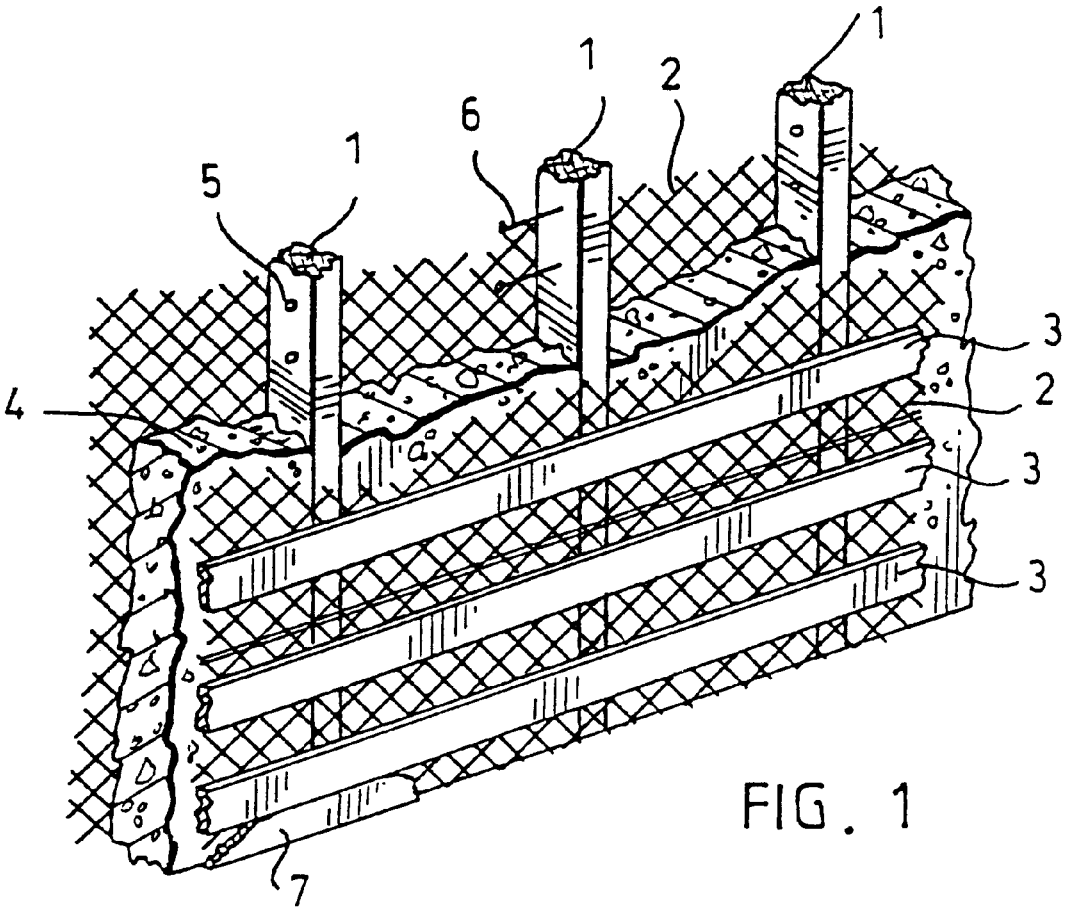

The invention relates to a wall construction comprising supporting poles and filling material cast between them.

Further, the invention relates to a method of manufacturing a wall construction, in which method supporting poles are mounted in place, a mould is mounted in such a way that the supporting poles remain inside the mould and filling material is cast inside the mould between the supporting poles.

It is known to build different wall constructions, but the problem often is that manufacturing a wall construction is complicated, laborious and slow and thus expensive. On the other hand, many insulations used for wall constructions cause problems with fire safety.

Finnish Publication 75 389 discloses a wall frame consisting of lightweight beams and foam concrete used as surface and filling material between the beams. The wall is made in such a way that a casting mould is fastened on the lightweight beams and the foam concrete is sprayed inside the casting mould. For the construction of the wall are required separate heavy and expensive moulds, due to which the wall is slow and expensive to manufacture.

German Offenlegungsschrift 42 15 081 discloses a clay wall element and a method of manufacturing it. The element comprises supports and a filling of light-weight clay and also notches and pins for attaching an element to other elements. The element is cast inside separate moulds, due to which the wall is difficult and expensive to manufacture.

British Patent 1 599 033 discloses a wall construction comprising studs, to which are fastened plasterboards. Further, porous plastics foam is cast between the plasterboards. However, the total costs of such a wall construction are high.

German Offenlegungsschrift 39 21 881 discloses a prefabricated wall element of wood. There are wooden parts both outside and inside the element in question and concrete shall be cast between them either in advance or on construction site. The material costs of such a wooden wall element are high and the element is slow and difficult to manufacture.

Finnish Publication 932 441 discloses an insulated wall of a wooden house. This wall comprises an outer layer of wood and between the outer and the inner layer an insulation consisting of mortar layers and layers of rammed chips. Such a wall has high material costs and is slow and complicated to manufacture.

An object of the present invention is to provide a wall construction, which is simple and stable and has a favourable price.

A further object of the invention is to provide a method of manufacturing a wall construction, by which method the wall construction can be made quickly and advantageously.

The wall construction according to the invention is characterized in that the wall construction comprises a close-meshed metal net attached at least to one side of the supporting poles, the metal net forming part of the wall construction and together with the filling material a reinforcement.

The method according to the invention is characterized in that a close-meshed metal net is attached at least to one side of the supporting poles, which net forms part of the mould, and that boards are attached at spaced intervals outside the metal net to support it, whereby the metal net acting as a mould forms part of the wall construction and together with the filling material a reinforcement.

The essential idea of the invention is that a close-meshed metal net forming part of the mould is attached to the supporting poles and boards are attached at spaced intervals outside the metal net. Subsequently, filling material is cast into spaces formed by the metal net and the supporting poles, whereby the net acting as a mould forms part of the wall construction and together with the filling material a reinforcement. Further, the idea of an embodiment is that a mixture of lightweight aggregate and concrete is used as filling material.

The advantage of the invention is that a wall construction made by the method is fire safe, quick to manufacture and simple and has a stable structure and a favourable price.

Figure 2:
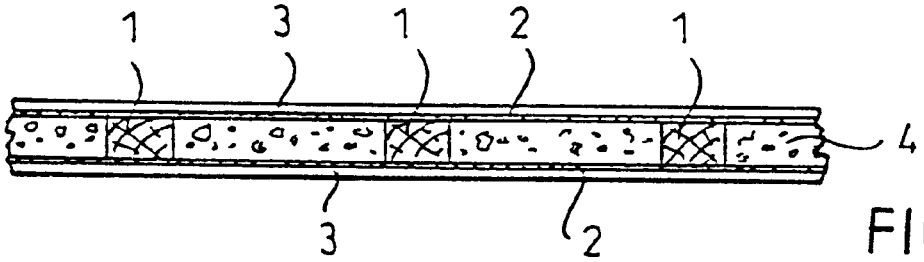
Figure 3:
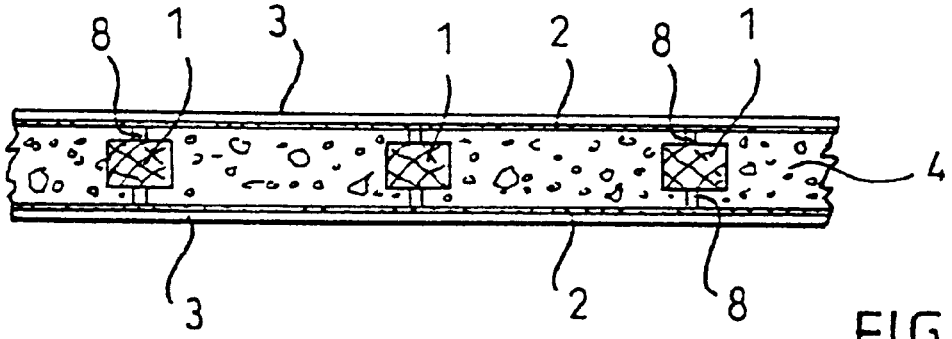

The invention will be described in greater detail in the attached drawings, in which FIG. 1 shows a wall construction according to the invention axonometricly and partly in cross-section, FIG. 2 shows the wall construction of FIG. 1 from above and FIG. 3 shows another wall construction according to the invention from above.

FIG. 1 shows a wall construction according to the invention. For making a wall construction, supporting poles 1 are erected at first. The supporting poles 1 preferably consist of impregnated wood and are fastened in place in their future position. The wooden supporting poles 1 constitute the main load-bearing structure. By using wooden supporting poles 1, a wall construction is simple, quick and advantageous to manufacture. A close-meshed metal net 2 is attached to both sides of the supporting poles 1. The term "close-meshed" means in this connection that the wires of the metal net 2 are so close to each other that the filling material intended for the wall construction is not able to flow substantially through the metal net 2. The metal net 2 is fastened to the wooden supporting poles 1 in a simple manner and very quickly for instance by means of clamp nails, small hooks, small nails or the like. The metal net 2 may comprise several net parts positioned adjacent to each other in such a way that they partially overlap each other. The metal nets 2 are supported on the opposite side of the supporting poles 1 by means of boards at spaced intervals. The term "at spaced intervals" means in this connection that boards 3 adjacent to each other are not attached to each other, but they are positioned at such intervals that the metal nets 2 do not bulge substantially when filling material is introduced between them. Since the metal net is supported during casting by an outside boarding, the metal net wire does not need to be very thick, due to which chicken wire, for instance, can be used as the metal net 2. After boarding, the proper filling material of the wall construction is mixed of lightweight aggregate and concrete, for instance, and the mixture 4 in question is cast between the metal nets 2 in such a way that it fills the space between the supporting poles 1 and remains tightly adhered to them. The filling material can also be a mixture of for instance blast-furnace slag or some other material and concrete or some other material preferably having a light specific weight. However, the mixture 4 of lightweight aggregate and concrete is advantageous, as far as price and insulation and fire safety properties are concerned. After the mixture 4 has solidified, the boarding can be removed, if desired, or left in place for possible appearance lining. To improve the adherence between the supporting poles 1 and the mixture 4, the supporting poles 1 may comprise, depending on constructions, for instance holes 5 or means of attachment, such as nails 6 or the like nailed into wooden poles, for instance. If desired, a finished wall construction can be coated for example with a plastering 7 or another similar material. Onto the supporting poles 1 can be fastened a horizontal cross-wood, to which for instance carrier beams of the roof can be attached.

On the one hand, the metal net 2 acts as a reinforcement and, on the other hand, as a casting mould and in a finished wall construction as a support corresponding to a concrete reinforcement and firmly attached to the filling material. Accordingly, the wall construction can act as a so-called bearing wall construction.

FIG. 2 shows the wall construction of FIG. 1 from above. The reference numerals of FIG. 2 correspond to the reference numerals of FIG. 1. The metal nets 2 are attached directly to the surface of the supporting poles 1, due to which there is substantially no mixture 4 of lightweight aggregate and concrete on the outer surfaces of the supporting poles 1.

FIG. 3 shows another embodiment of the wall construction according to the invention. The reference numerals of FIG. 3 correspond to the reference numerals of FIGS. 1 and 2. In the wall construction according to FIG. 3, the metal nets 2 are attached to the supporting poles 1 by means of bearers 8. The supporting poles 1 then remain on all sides substantially inside the mixture of lightweight aggregate and concrete to be cast. An uncoated wall construction substantially uniform in appearance is thus provided, in which construction only the ends of the bearers 8 remain to be seen. In the cases shown in Figure and FIG. 3, the wooden supporting poles 1 serve especially well as battens for nailing, which can be utilized for an easy fastening of a possible outer and inner lining of the wall construction.

The drawing and the description attached thereto are only intended to illustrate the idea of the invention. As to the details, the invention may vary within the scope of the invention. So the method and the wall construction according to the invention can be used for instance for repairing old buildings in such a way that supporting poles 1 are mounted on an old wall and outside them a metal net 2 and a boarding. Subsequently, filling material, for example a mixture 4 of lightweight aggregate and concrete, is cast between the old wall and the metal net 2 and the boarding.

I claim:

1. A wall construction comprising supporting poles, filling material cast between them and means acting as a mould and forming part of the wall construction and together with the filling material a reinforcement, said means being arranged to stay in a predetermined position, wherein supporting poles are wooden and a close-meshed metal net is used as means acting as a mould and that the close-meshed metal net is attached at least to one side of the wooden supporting poles, so that the metal net stays in a predetermined position, wherein the metal net is attached to both sides of the supporting poles.

2. Wall construction according to claim 1, wherein the filling material is a mixture of lightweight aggregate and concrete.

3. Wall construction according to claim 1, wherein the filling material is a mixture of blast-furnace slag and concrete.

4. Wall construction according to claim 1, wherein the supporting poles are made of impregnated wood.

5. Wall construction according to claim 1, wherein the supporting poles have holes for improving the adherence of the filling material.

6. Wall construction according to claim 1, wherein the supporting poles comprise means of attachment for improving the adherence of the filling material.

7. Wall construction according to claim 1, wherein there is a plastering on the metal net.

8. A wall construction comprising supporting poles, filling material cast between them and means acting as a mould and forming part of the wall construction and together with the filling material a reinforcement, said means being arranged to stay in a predetermined position, wherein supporting poles are wooden and a close-meshed metal net is used as means acting as a mould and that the close-meshed metal net is attached at least to one side of the wooden supporting poles, so that the metal net stays in a predetermined position, wherein the metal net comprises several net parts, which are positioned partly overlappingly.

9. Method of manufacturing a wall construction, in which method supporting poles are mounted in place, a mould is mounted in such a way that the supporting poles remain inside the mould and that the walls of the mould stay in a predetermined position and filling material is cast inside the mould between the supporting poles and that the mould forms part of the wall construction and together with the filling material a reinforcement, wherein the supporting poles are wooden and that a close-meshed metal net is attached at least to one side of the wooden supporting poles so that the metal net stays in a predetermined position, which net forms part of the mould, and that boards are attached at spaced intervals outside the metal net to support the metal net.

10. Method according to claim 9, wherein a mixture of lightweight aggregate and concrete is used as filling material.

11. Method according to claim 9, wherein a mixture of blast-furnace slag and concrete is used as filling material.

12. Method according to claim 9, wherein the metal net is attached to both sides of the supporting poles.

13. Method according to claim 9, wherein poles made of impregnated wood are used as supporting poles.

14. Method according to any of the preceding claims 9 to 13, wherein the supporting poles are provided with holes for improving the adherence of the filling material.

15. Method according to claim 9, wherein the supporting poles comprise means of attachment for improving the adherence of the filling material.

16. Method according to claim 9, wherein the wall construction is coated with a plastering.

17. Method according to claim 9, wherein the metal net comprises several net parts, which are positioned partly overlappingly.

* * * * *